US009585489B1

(12) United States Patent
Al-Quraini

(10) Patent No.: US 9,585,489 B1
(45) Date of Patent: Mar. 7, 2017

(54) PORTABLE FOOT AND LEG REST ASSEMBLY

(71) Applicant: Jeehan A. M. T. Al-Quraini, Safat (KW)

(72) Inventor: Jeehan A. M. T. Al-Quraini, Safat (KW)

( * ) Notice: Subject to any disclaimer, the term of this patent is extended or adjusted under 35 U.S.C. 154(b) by 0 days.

(21) Appl. No.: 15/253,838

(22) Filed: Aug. 31, 2016

(51) Int. Cl.
*A47C 16/02* (2006.01)

(52) U.S. Cl.
CPC ..... *A47C 16/025* (2013.01)

(58) Field of Classification Search
CPC ..... A47C 16/025; A47C 12/00; B66F 7/065
USPC ..... 297/423.45, 423.14, 423.39, 120, 233; 108/69, 71, 101, 158.12, 158.13
See application file for complete search history.

(56) References Cited

U.S. PATENT DOCUMENTS 596,525 A * 1/1898 Moore ..... A47C 9/08 297/105
658,275 A * 9/1900 Musser ..... A47B 1/04 108/69
1,073,128 A * 9/1913 Hofmayr ..... A47B 1/05 108/71
1,147,788 A * 7/1915 Coss ..... A47B 1/05 108/71
1,335,973 A * 4/1920 Kesselman ..... A47C 1/023 297/107
2,596,663 A * 5/1952 Duffy ..... A47B 87/002 108/185
2,760,558 A 7/1952 Ayers
2,708,614 A * 5/1955 Paredes ..... A47B 1/05 108/71
3,051,527 A 8/1962 McKenna et al.
3,066,322 A 12/1962 Derby
4,148,264 A * 4/1979 Caravias ..... A47B 3/00 108/12
4,151,804 A * 5/1979 Wache ..... A47B 9/00 108/147
4,232,901 A * 11/1980 Harrington ..... A47C 16/025 108/147

(Continued)

FOREIGN PATENT DOCUMENTS

DE 3933915 4/1991

OTHER PUBLICATIONS

"Adjustable Padded Footstool" Walter Drake Website.
"Omax new Office foot rest adjustable Folding footstool Ottoman" Alibaba.com.

*Primary Examiner* — Timothy J Brindley
(74) *Attorney, Agent, or Firm* — Richard C. Litman

(57) ABSTRACT

The portable foot and leg rest assembly includes a main body and an extendible support assembly attached to a lower surface of the main body. The main body includes a top portion, a base portion, and an intermediate portion provided between the base portion and top portion. The intermediate portion includes removable dual leaf members. The leaf members are attachable to the top portion. The extendible support assembly includes first and second leg members and a stand member. The first and second leg members slidably engage the base portion and the stand member. The stand member includes a control assembly which is configured to selectively lock the first and second leg members at a desired position and thereby set the portable foot and leg assembly at a desired height.

18 Claims, 14 Drawing Sheets

(56) References Cited

U.S. PATENT DOCUMENTS

| | | | | |
|---|---|---|---|---|
| 5,285,992 | A * | 2/1994 | Brown | B66F 7/0608 108/147 |
| 5,489,144 | A | 2/1996 | Lewis | |
| 6,046,269 | A | 4/2000 | Nass | |
| 6,174,026 | B1 * | 1/2001 | Wise | A47B 85/00 108/17 |
| 6,295,987 | B1 * | 10/2001 | Parker | A47C 16/025 108/116 |
| 7,000,558 | B2 * | 2/2006 | Johnson | B63B 3/08 114/266 |
| 7,066,547 | B1 | 6/2006 | Russell et al. | |
| 7,669,934 | B1 | 3/2010 | Cline | |
| 8,162,396 | B2 * | 4/2012 | Edwards | A47C 4/02 297/188.08 |
| 8,267,477 | B1 | 9/2012 | Appiah Finn | |
| 2002/0170470 | A1 * | 11/2002 | Cheng | B60N 3/002 108/69 |
| 2003/0168899 | A1 | 9/2003 | Voyce, IV | |
| 2004/0035333 | A1 * | 2/2004 | Lucatello | A47B 1/03 108/65 |
| 2005/0151408 | A1 | 7/2005 | Pratte et al. | |
| 2005/0225151 | A1 | 10/2005 | Zenisek | |
| 2006/0272893 | A1 * | 12/2006 | Foggio | A47C 16/025 182/69.1 |
| 2008/0156589 | A1 * | 7/2008 | Marchand | B66F 7/065 187/219 |
| 2010/0146707 | A1 * | 6/2010 | Calvo | A47C 20/021 5/648 |
| 2011/0181091 | A1 * | 7/2011 | Kim | A47C 16/025 297/423.41 |
| 2016/0249737 | A1 * | 9/2016 | Han | B60P 3/34 |

* cited by examiner

PORTABLE FOOT AND LEG REST ASSEMBLY

BACKGROUND OF THE INVENTION

1. Field of the Invention

The present invention relates to a foot and leg support, and more particularly to a portable foot and leg rest assembly including a height adjustment feature.

2. Description of the Related Art

Devices used for resting a foot or leg are generally known. When a person is seated for a long time, he or she may use a footstool, an ottoman, or a leg rest to provide comfort and support to the lower extremities. A comfortable resting position for the leg is generally at a different elevation than that of the resting position of the foot. Conventional devices cannot provide a comfortable resting elevation for both the leg and the foot. Accordingly, a user typically uses separate devices for resting the foot and the leg.

Accordingly, there exists a need for a foot and leg rest assembly that can be used as a leg rest and a foot rest.

SUMMARY OF THE INVENTION

The portable foot and leg rest assembly includes a main body and an extendible support assembly attached to a lower surface of the main body. The main body includes a top portion, a base portion, and an intermediate portion provided between the base portion and top portion. The intermediate portion includes removable dual leaf members. The leaf members are attachable to the top portion. The extendible support assembly includes first and second leg members and a stand member. The first and second leg members slidably engage the base portion and the stand member. The stand member includes a control assembly which is configured to selectively lock the first and second leg members at a fixed position and thereby set the portable foot and leg assembly at a desired height.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a versatile foot and leg rest assembly, which is foldable into a compact configuration, peimitting the foot and leg rest assembly to be carried by the user. The foot and leg rest assembly is configured for height adjustment between a leg resting position and a foot resting position.

Figure 1:
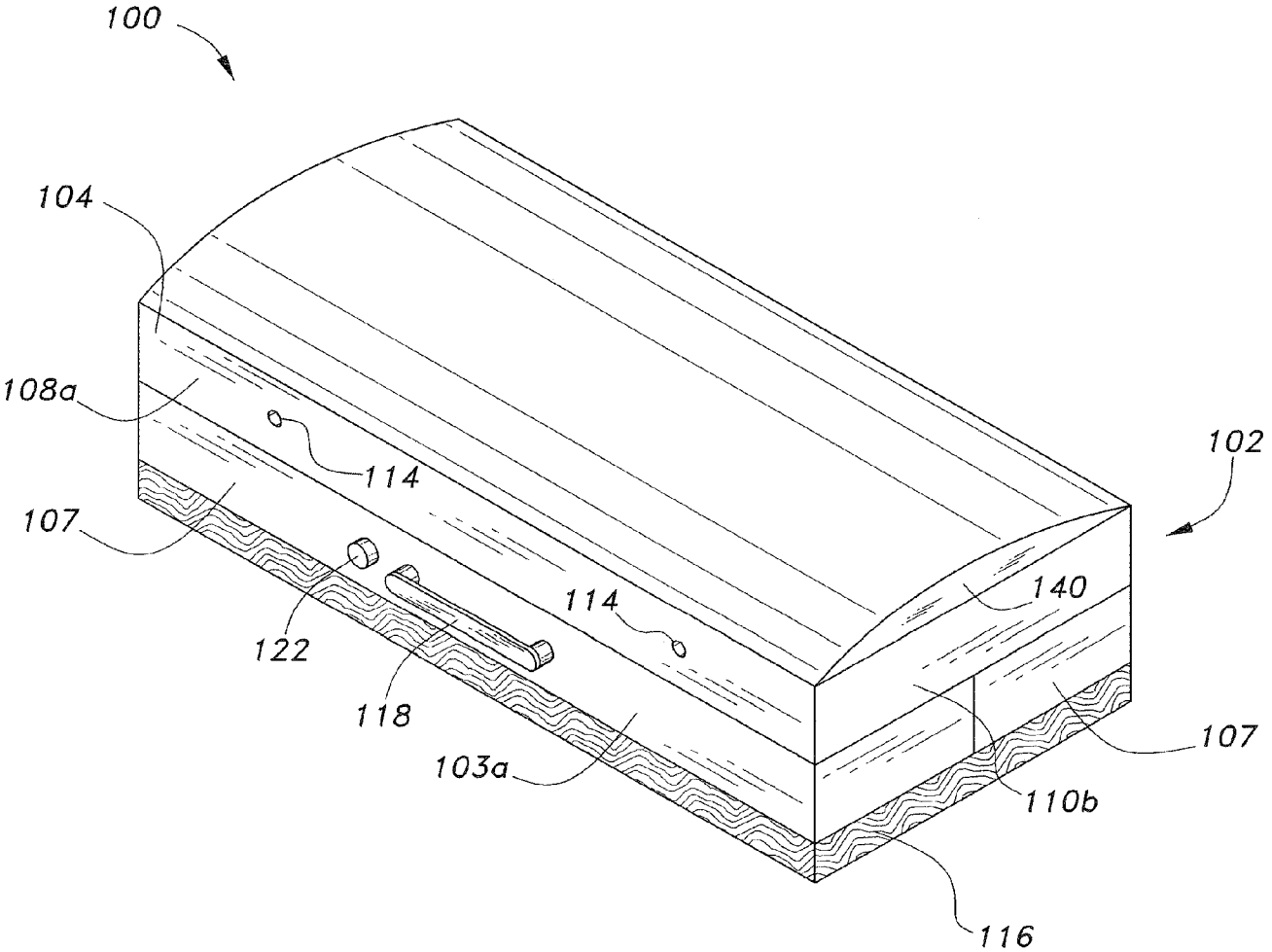
FIG. 1 is an environmental, perspective view of a foot and leg rest assembly, according to the present invention, in a folded configuration.
Figure 2:
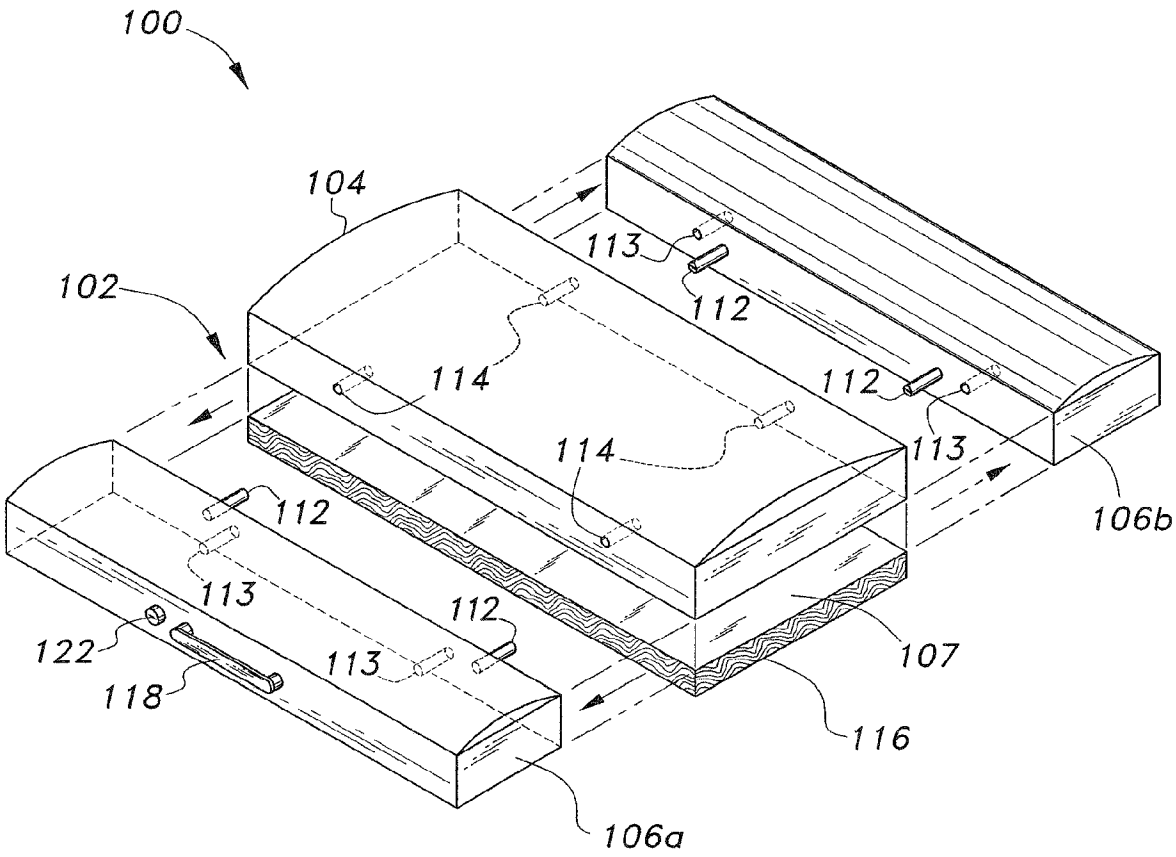
FIG. 2 is an exploded perspective view of the foot and leg rest assembly of FIG. 1, illustrating the removal of attachable side leaf members from an intermediate portion of the portable foot and leg rest assembly.

Referring now to FIG. 1, there is shown a foot and leg rest assembly 100, in accordance with the present invention. As illustrated, the foot and leg rest assembly 100 includes a generally rectangular-shaped main body 102 and an adjustable support assembly 124 (seen in FIG. 6) attached to the main body. The support assembly 124 is operatively connected to the main body 102, and is selectively expandable to enable a user to lower and raise the main body 102 to a desired elevation.

The main body 102 includes a top portion 104. The top portion 104 includes first and second sides 108*a*, 108*b*, and third and fourth sides 110*a*, 110*b* which extend between and connect first and second sides 108*a* and 108*b* to form a generally rectangular structure. The body 102 further includes an intermediate portion 107, and a lower base portion 116, positioned generally below the intermediate portion 107. The base portion 116 is operatively connected to the adjustable support assembly 124. The base portion 116 has a hollow lower portion for housing the support assembly 124 when the foot and leg rest assembly 100 is in a folded, compact configuration.

The intermediate portion 107 can include leaf members 106*a*, 106*b*. The leaf members 106*a* and 106*b* may be stored in a compartment or space 120 formed in the intermediate portion 107 of the foot and leg rest assembly 100. The leaf members 106*a*, 106*b* may be removed from the compartment 120, and attached to the top portion 104 to provide a larger surface upon which the user may rest his or her leg. It is also contemplated that the leaf members 106*a*, 106*b* may be connected to the base portion 116, if desired.

Figure 3:
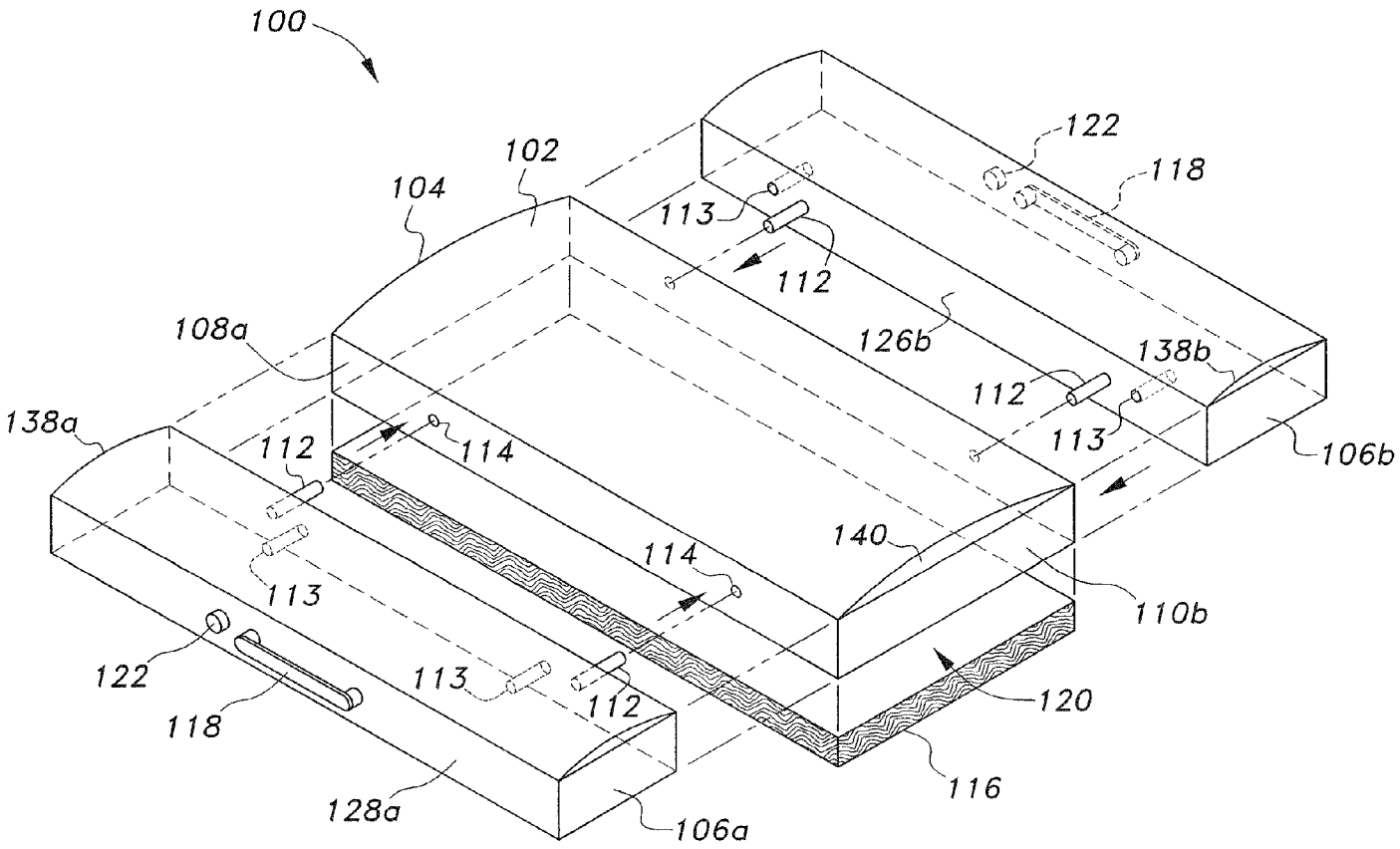
FIG. 3 is an exploded perspective view of the foot and leg rest assembly of FIG. 1, illustrating attachment of the dual leaf members to a top portion of the foot and leg rest assembly to increase the support surface for the leg or foot.
Figure 4:
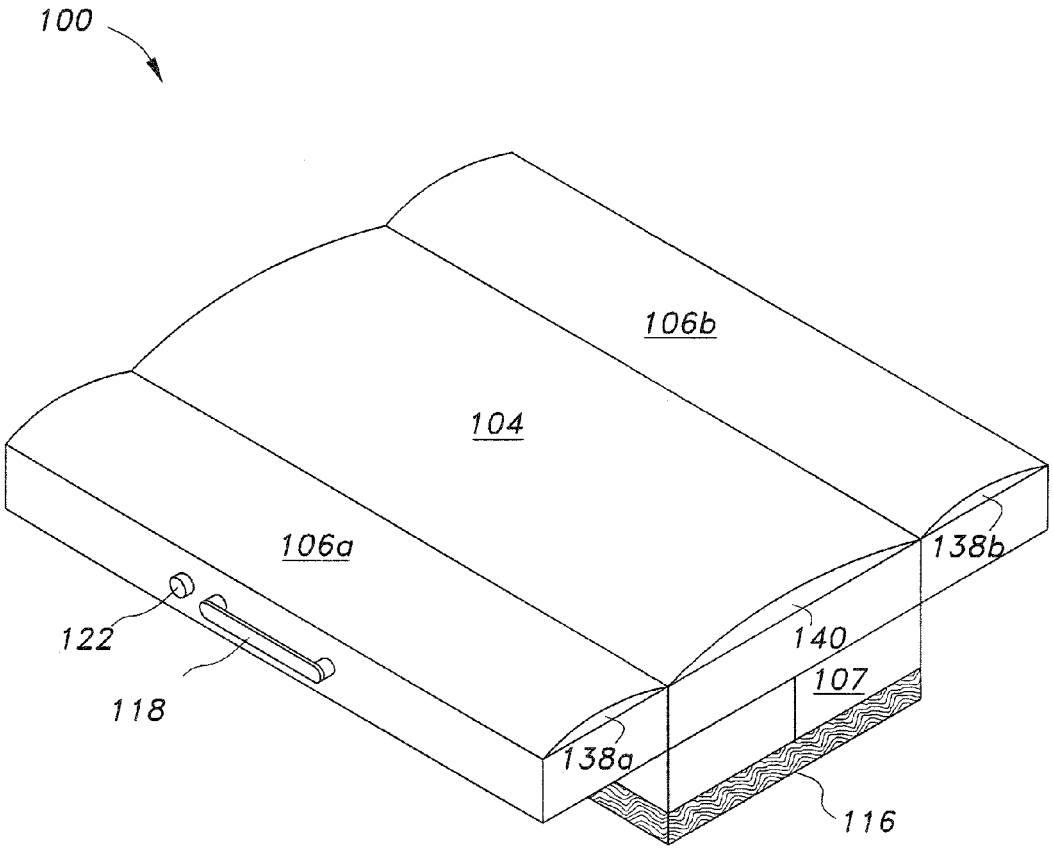
FIG. 4 is an exploded perspective view of the foot and leg rest assembly of FIG. 1, illustrating the dual leaf members attached to a top portion of the foot and leg rest assembly to increase the support surface for the leg or foot.

A release button 122 may be provided directly on each respective leaf member 106*a*, 106*b*, or on an external panel (not shown). The release button is configured to facilitate release and removal of the leaf members 106*a* and 106*b* from the compartment 120, and also from the top portion 104 when detached. As illustrated, each leaf member 106*a*,

106*b* may also include a handle 118, provided on an outer wall of the respective leaf member 106*a*, 106*b*. The handle 118 may be grasped by the user to facilitate removal of the respective leaf member 106*a*, 106*b* and/or to carry the foot and leg assembly when in a folded configuration. Each leaf member 106*a*, 106*b* includes one or more locking pins 112 which extend from inner walls 126*a*, 126*b* of the respective leaf members 106*a*, 106*b*, to facilitate attachment of the leaf members 106*a*, 106*b* to the top portion 104. As illustrated in FIG. 3, the first and second sides 108*a* and 108*b*, respectively, of the top member 104 includes one or more openings 114 to receive the respective locking pins 112 of the leaf members 106 to secure the leaf members 106*a*, 106*b* to the top portion 104. Each leaf member 106*a* and 106*b* includes one or more openings 113 at the inner walls 126*a* and 126*b*, respectively to receive the locking pins 112 of each other to secure the leaf members 106*a*, 106*b* when folded into the compartment 120. Locking pins 112 and openings 113 of the leaf members 106*a* and 106*b* are located in proper positions to facilitate the attachment to each other and to the top portion 104. As illustrated in FIG. 4, the leaf members 106*a*, 106*b* can be attached to the top portion 104, expanding the overall surface upon which a user's foot or leg may be supported. The extension members 106*a*, 106*b* can include cushion cover portions 138*a*, 138*b*.

Figure 5:
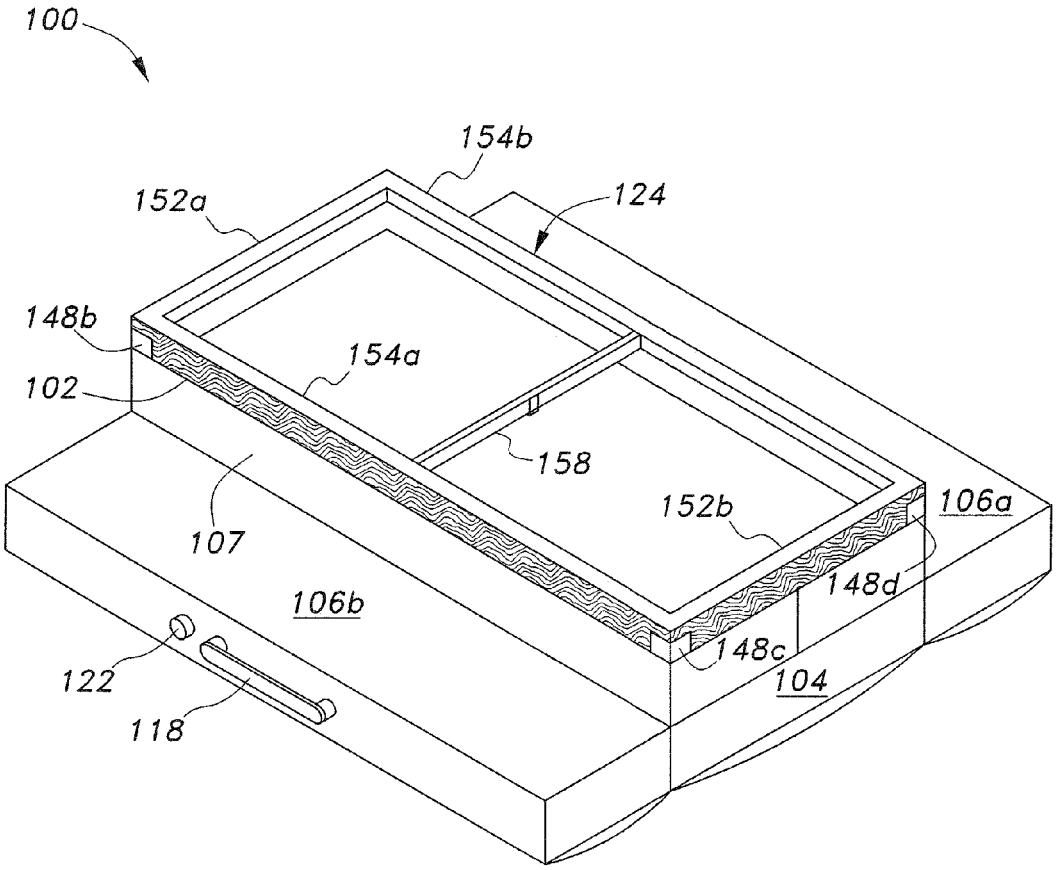
FIG. 5 is bottom view of the foot and leg rest assembly, illustrating a base portion and support assembly.

FIG. 5 illustrates a bottom view of the foot rest and leg rest assembly 100, in a folded position. As illustrated, the base portion 116 of the foot and leg rest assembly 100 is configured to store the adjustable support assembly 124 in a folded position therein. The base portion 116 includes sidewalls 152*a*, 152*b*, and 154*a*, 154*b* within which the support assembly 124 is stored. The support assembly 124 can be formed from metal or other suitable material. As illustrated, magnetic fasteners 148*a*, 148*b*, 148*c*, 148*d* may be provided at selected locations on the base portion 116, such as at corners of the base portion 116 to connect the support assembly 124 to the sidewalls 152*a*, 152*b*, and 154*a*, 154*b* of the base portion 116.

Figure 6:
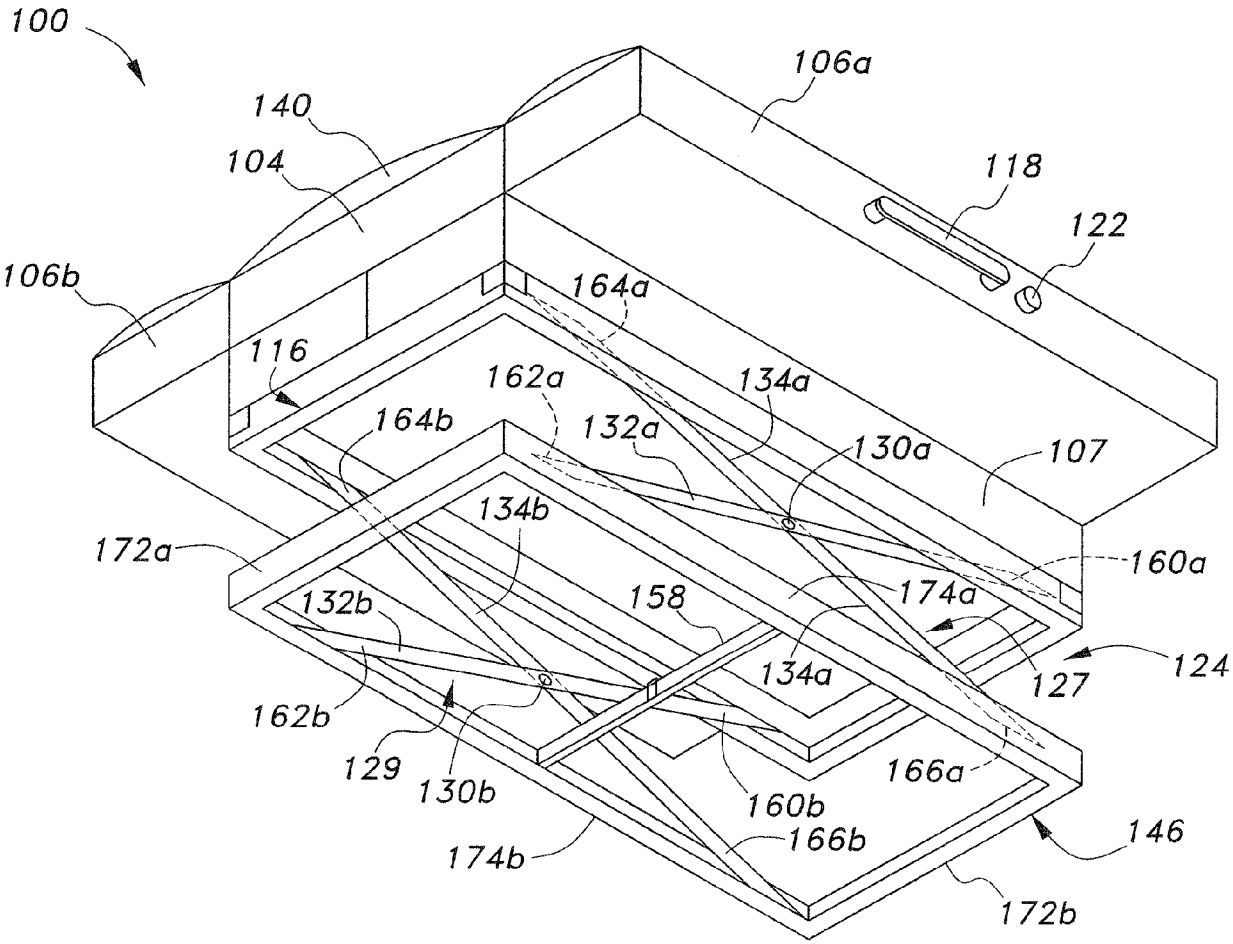
FIG. 6 is a bottom view of the foot and leg rest assembly of FIG. 1, illustrating the support assembly in a first extended configuration.
Figure 7:
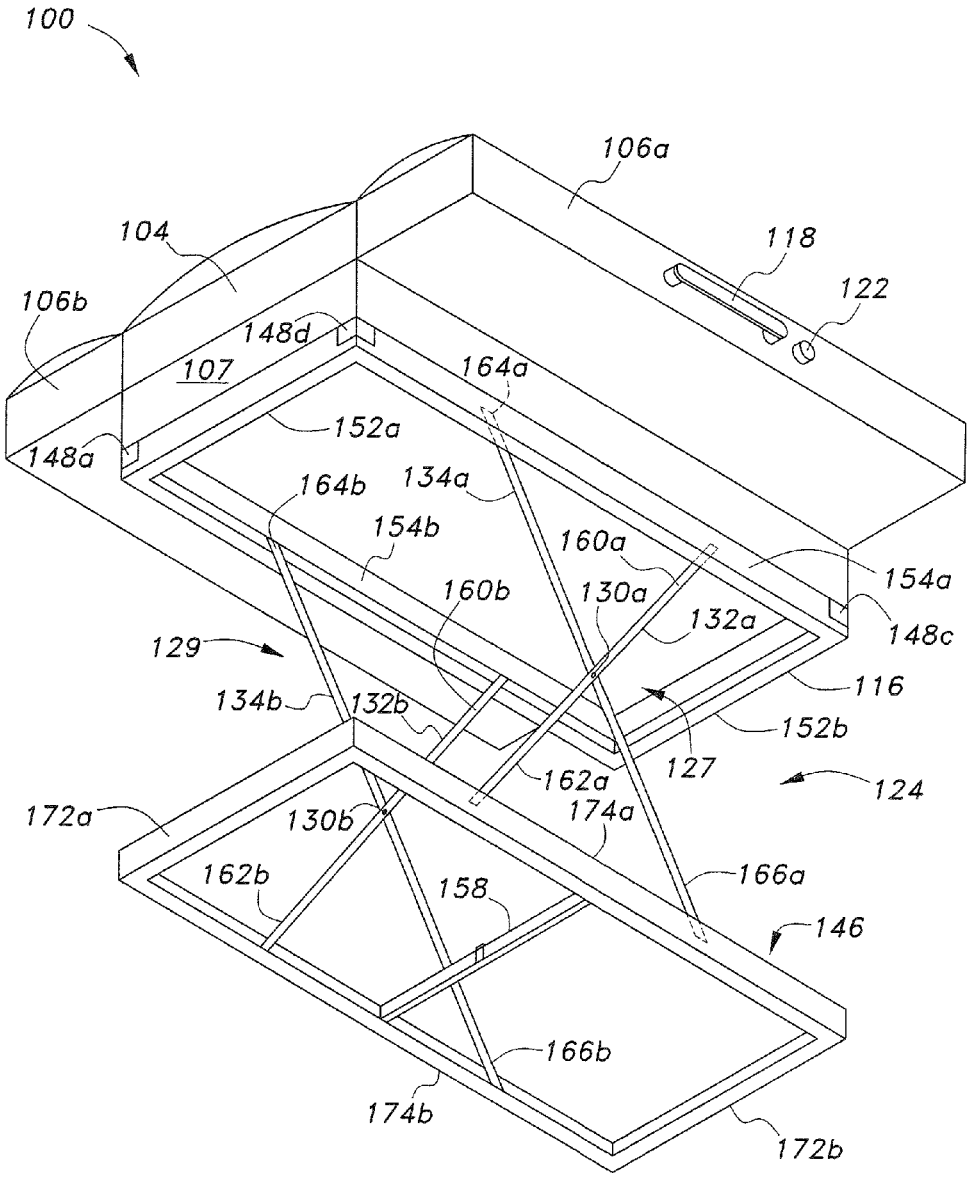
FIG. 7 is a bottom view of the foot and leg rest assembly of FIG. 1, illustrating the support assembly in a second extended configuration.

FIGS. 6 and 7 are perspective views of the foot and leg rest assembly 100, illustrating the support assembly 124 in an extended position. The support assembly 124 is capable of being extended and retracted. The adjustability of the support assembly 124 permits the top member 104 and cover 140, along with the removably attached leaf members 106*a*, 106*b* to be adjusted to a plurality of different elevations. FIG. 6 illustrates the support assembly 124 in a partially extended position. The support assembly 124 includes a stand member 146, a first leg member 127 and a second leg member 129. The first leg member 127 includes a first segment 132*a* and a second segment 134*a* which are joined in a scissor-like configuration and connected by pivot pin 130*a*. The second leg member 129 includes a first segment 132*b* and a second segment 134*b* which are joined in a scissor-like configuration and connected by pivot pin 130*b*.

Each first segment 132*a*, 132*b* slidably engages the base portion 116 at first or proximal end portions 160*a*, 160*b*, respectively, and slidably engages the stand member 146 at second distal end portions 162*a*, 162*b*, respectively. Similarly, each second segment 134*a*, 134*b* slidably engages the base portion 116 at first proximal end portions 164*a*, 164*b*, respectively, and slidably engages the stand member 146 at second distal end portions 166*a*, 166*b*, respectively. As such, segments 132*a*, 134*a* and 132*b*, 134*b* are slidable within the respective base portion 116 and stand member 146, permitting the support assembly 124 to be lifted and lowered into variable positions and heights.

Figure 8:
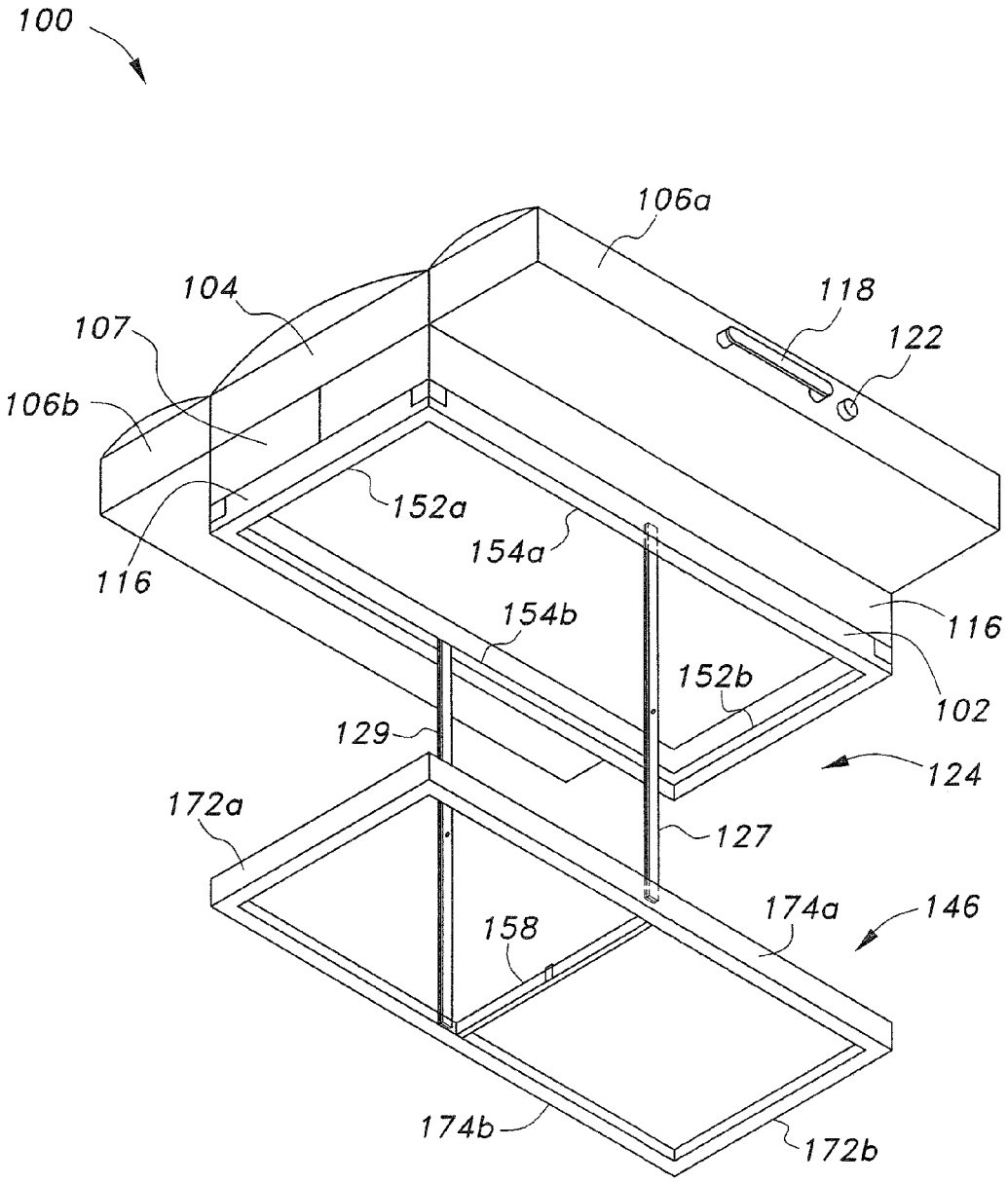
FIG. 8 is a bottom view of the foot and leg rest assembly of FIG. 1, illustrating the support assembly in a third extended configuration.

As illustrated in FIG. 8 the leg assembly 124 is capable of assuming various heights. As shown, the leg members are extendable to a maximum height, in which the leg members 127 and 129 are positioned generally perpendicular relative to the base portion 116 and stand member 146.

Figure 9:
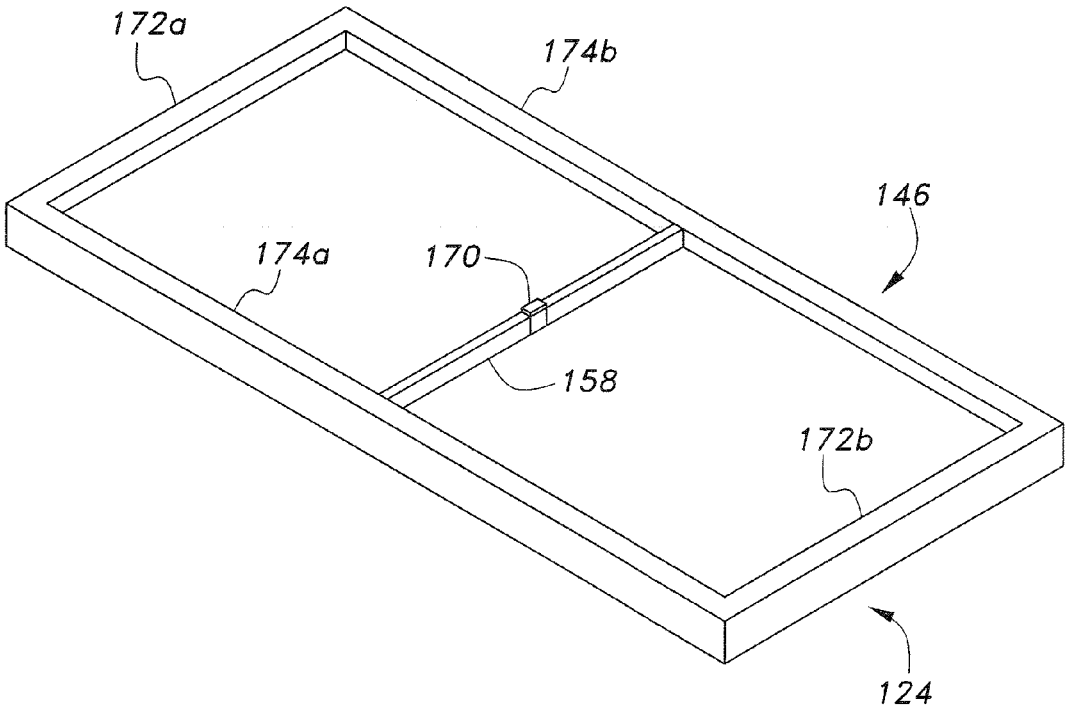
FIG. 9 is a perspective view of the stand member of the support assembly.
Figure 10:
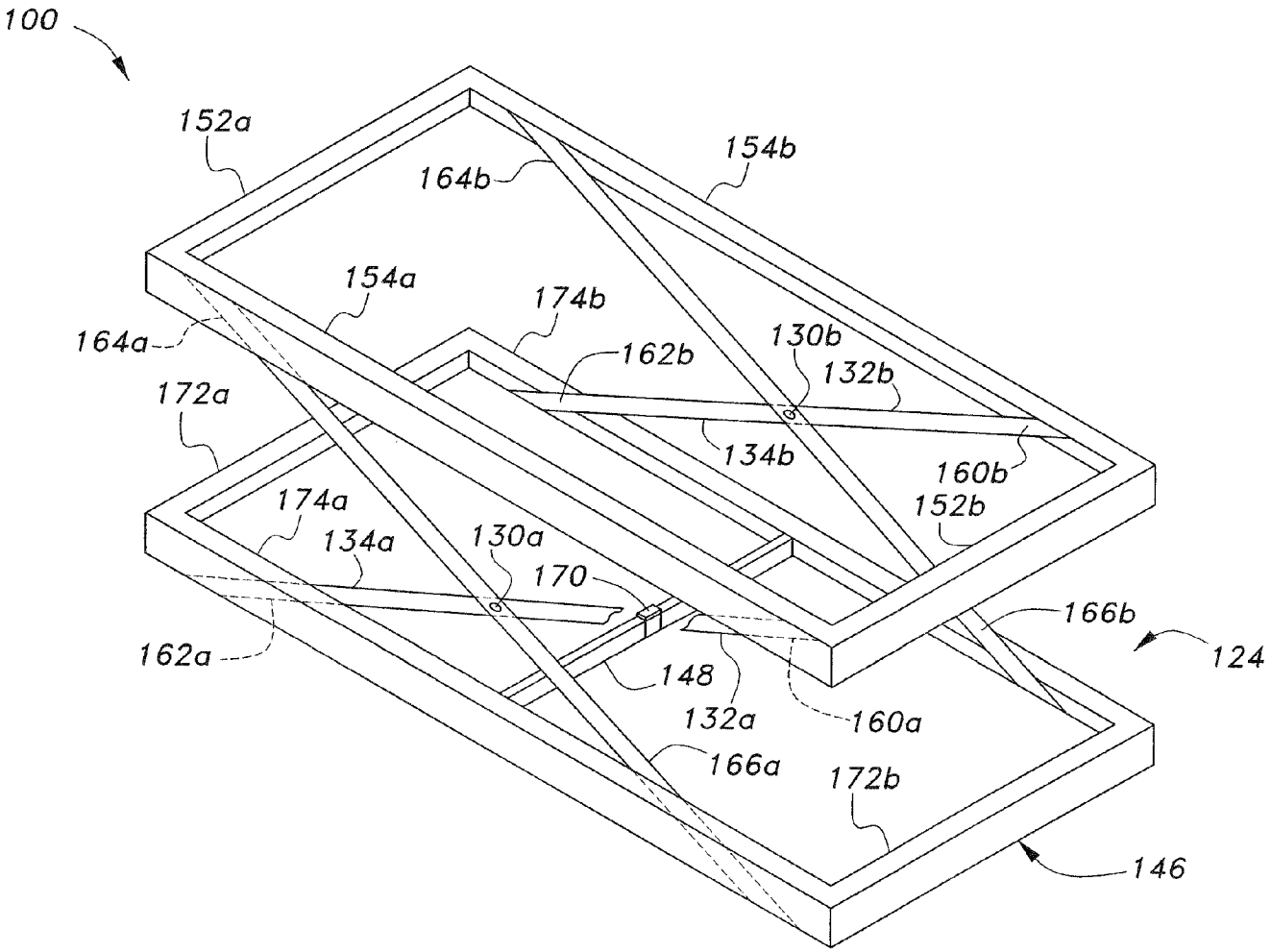
FIG. 10 is a perspective view of the support assembly, illustrating leg members in a partially extended position.
Figure 11:
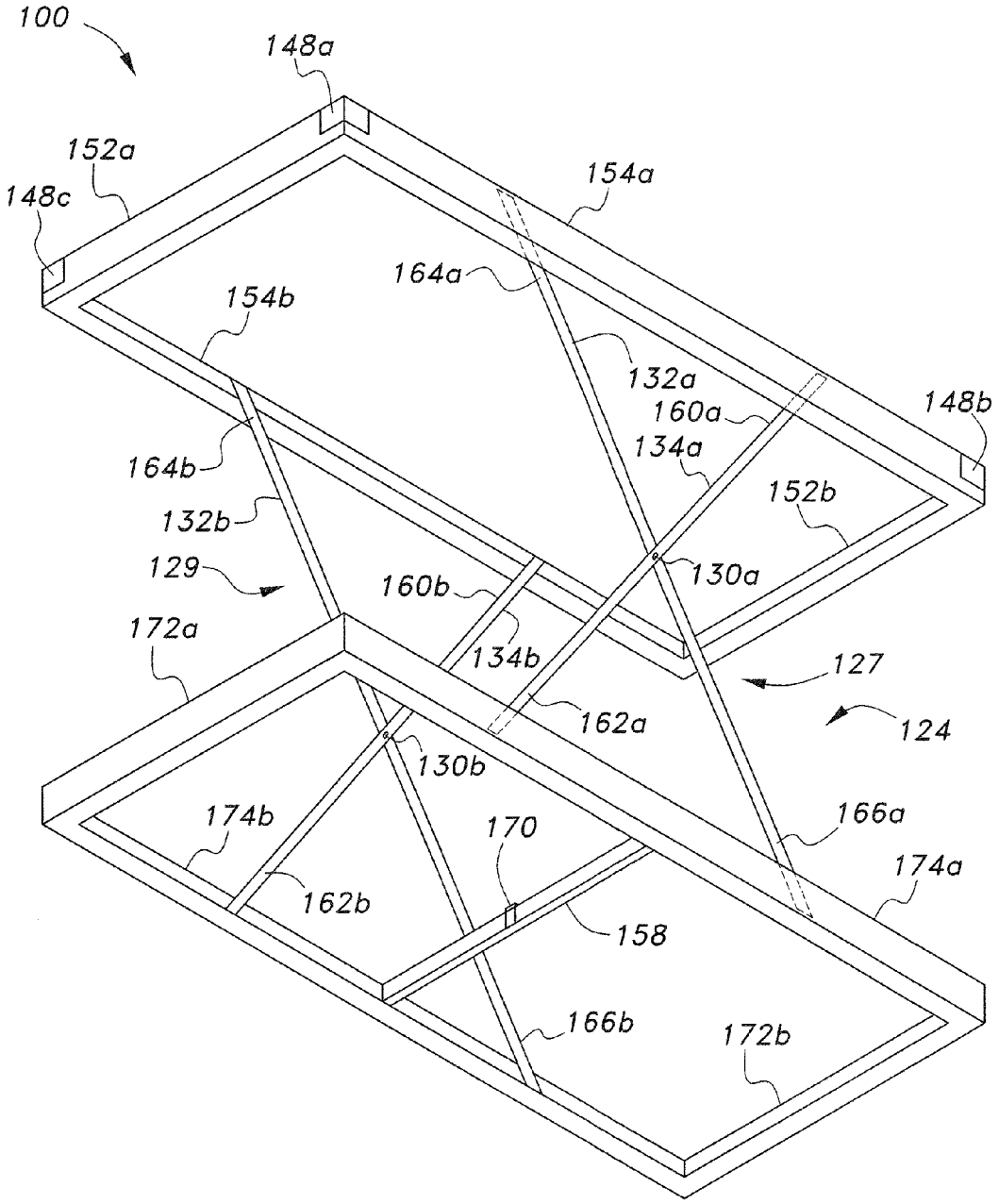
FIG. 11 is a perspective view of the support assembly, illustrating the leg members in an extended position.

As illustrated in FIG. 9, the stand member 146 includes side wall brace members 174*a*, 174*b*, which define a length of the stand member 146, and side members 172*a*, 172*b*, which define a width of the stand member 146. The stand member 146 includes a control assembly 158 configured to permit the distal end portions 162 and 166 of the respective leg members 127 and 129 to be locked into a selected position, thereby locking the foot and leg rest assembly at a selected height. The control assembly 158 extends between the side wall brace members 174*a*, 174*b*, providing additional stability to the stand member 146. As shown in FIG. 10, the control assembly 158 includes a control switch 170 for controlling movement of the end portions of the respective leg members 127 and 129. FIGS. 10 and 11 illustrate the support assembly 124 at a partially lowered position and a raised position, respectively.

Figure 12:
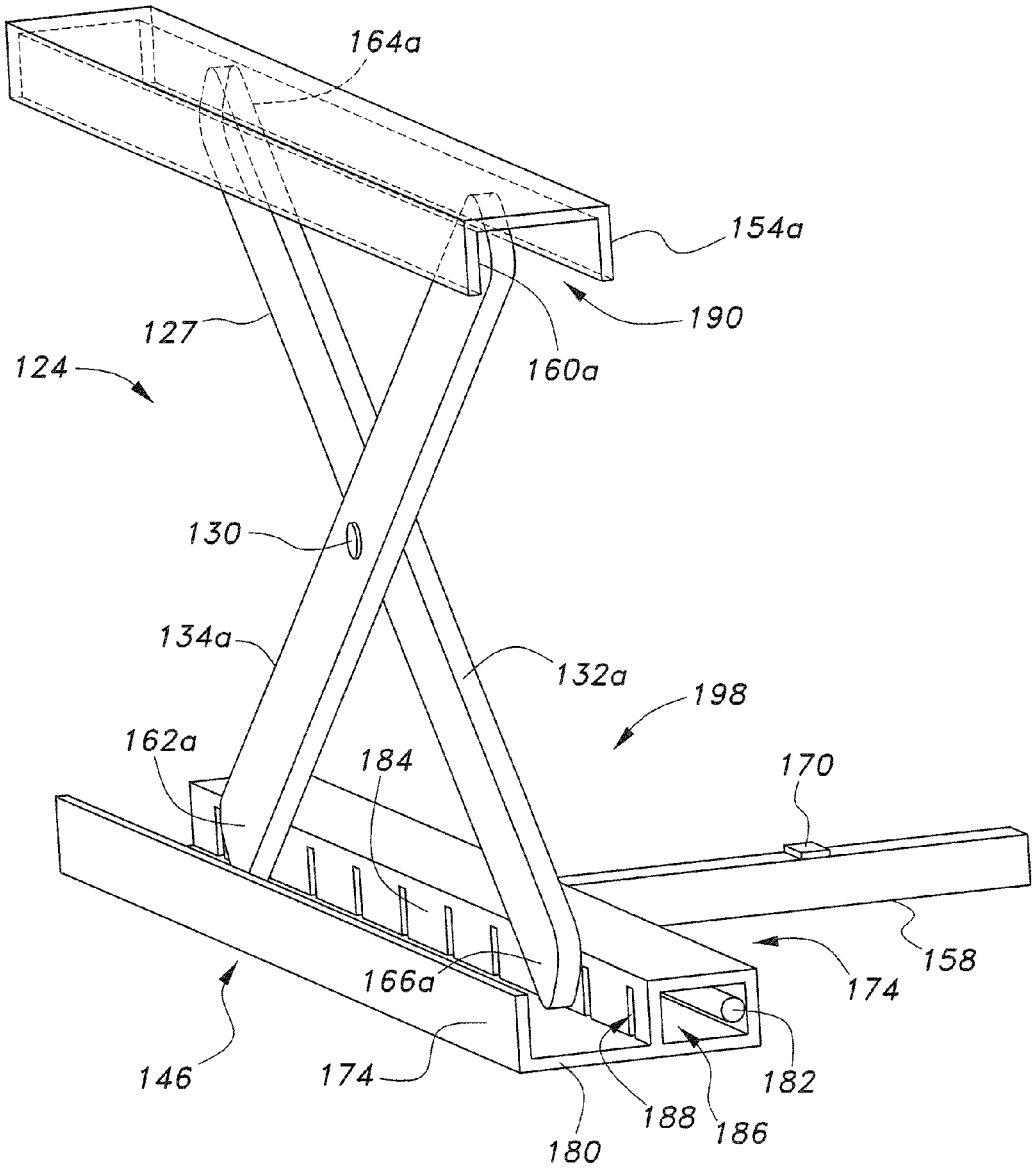
FIG. 12 is a partial perspective view of the support assembly, illustrating the stand member, a track for slidable adjustment of the leg members, and stop members in a retracted position.
Figure 13:
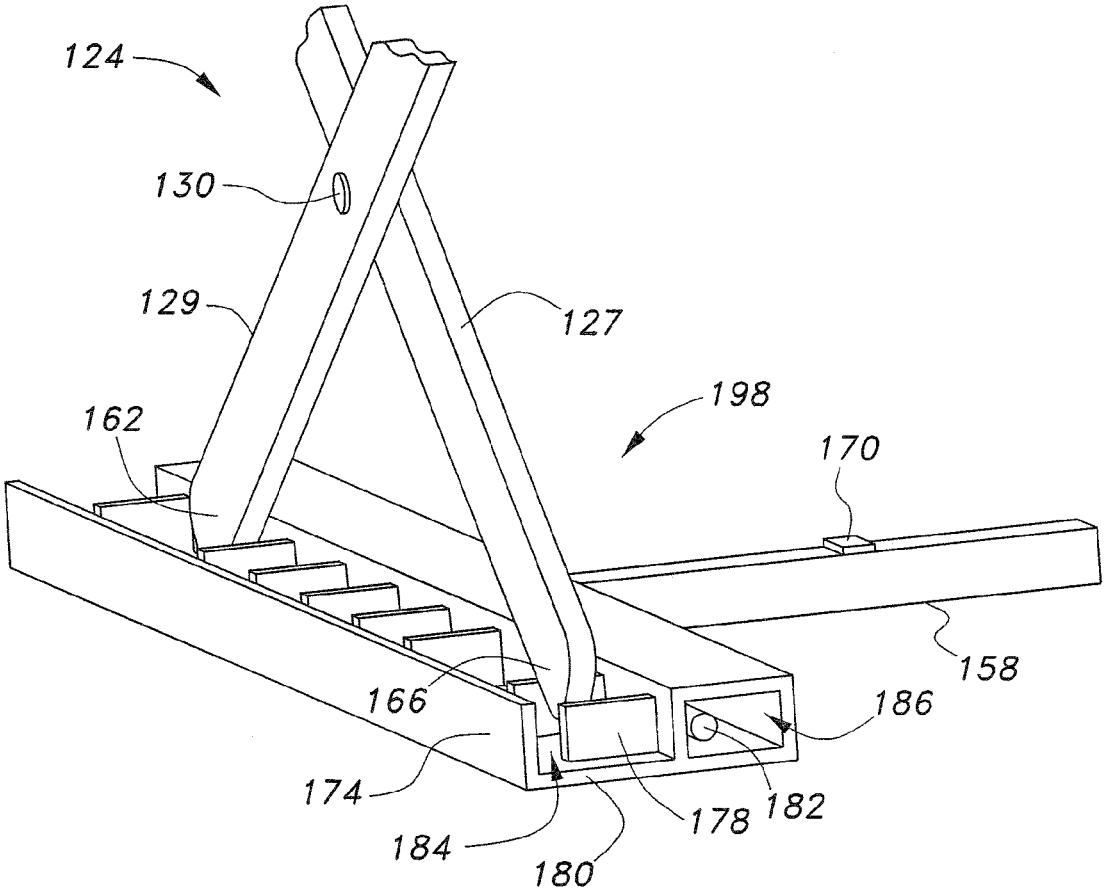
FIG. 13 is a partial perspective view of the support assembly, illustrating the stop members engaged with distal end portions of the leg members to hold the leg members in an upright position.
Figure 14:
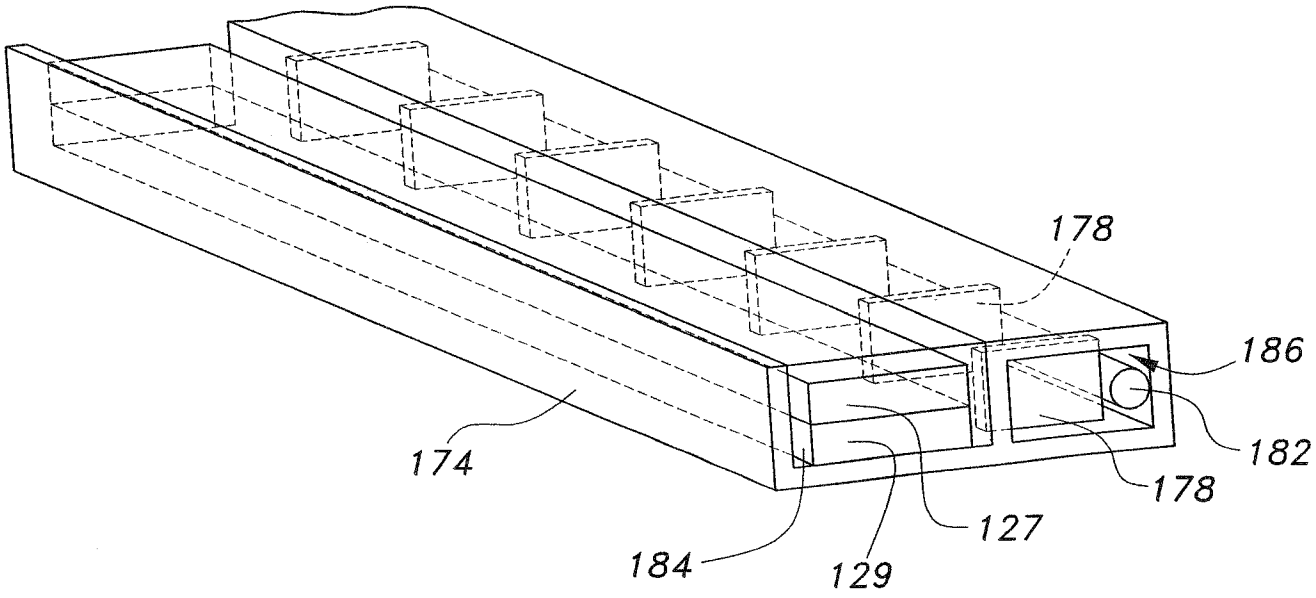
FIG. 14 is a perspective view of the support assembly, illustrating the leg members in a folded retracted position.

As shown in FIGS. 12-14, the leg member 127 has respective distal end portions 162*a* and 166*a* positioned on a track 180 of the side wall member 174 of the stand member 146. Slots 188 are provided along the inner surface 184 of the sidewall member 174. As illustrated in FIG. 13, the end portions 162*a* and 166*a* may be locked into place by stop members 178, which selectively extend through slots 188. The stop members 178 are connected to a rod member 182 provided in an inner cavity 186 of the side wall member. When end portions 162*a* and 166*a* are being adjusted, end portions 160*a* and 164*a* of leg members 127 are configured to simultaneously slide along a track portion 190 in the sidewall 154*a*. Although not shown, leg member 129 similarly engages the base portion 116 and stand member 146. The control assembly 158 may be provided on the base portion 116 to permit the proximal end portions to be locked in a selected location within the base portion 116

As illustrated, in FIG. 14, the portable foot and leg rest assembly 100 is configured to accommodate the legs 127 and 129 within base portion 116 once folded. The support assembly 124 is secured within the base portion 116, and retained within the base portion 116 by magnetic fasteners 148 *a-d*

I claim:

1. A portable foot and leg rest assembly, comprising:

a main body including a top portion, a base portion and an intermediate portion provided between the base portion and top portion, the intermediate portion including at least one leaf member; and a foldable support assembly including first and second leg members and a stand member, each of the first and second leg members including first and second leg segments, the first and second leg segments being pivotably joined together, the first and second leg members being slidably connected to the base portion and to the stand member, the stand member including a first brace member, a second brace member, and a control assembly configured to facilitate height adjustment of the foot and leg rest assembly, wherein the first and second brace members each include an inner cavity and a track portion, the inner cavity including a rod member having a plurality of stop members extending therefrom, the stop members being configured to selectively extend into the track portion of the stand member to support distal ends of respective leg segments therebetween;

wherein the at least one leaf member is configured for removable attachment to the top portion.

2. The foot and leg rest assembly according to claim 1, wherein the first and second segments of each leg member are arranged in a scissor-like configuration and connected together by a pivot pin member.

3. The portable foot and leg rest assembly according to claim 1, wherein the control assembly is configured to selectively lock the distal portion of the leg segments into a selected position within the stand member, thereby locking the foot and leg rest assembly at a selected height.

4. The portable foot and leg rest assembly according to claim 1, wherein the base portion has a hollow lower portion for housing the support assembly.

5. The foot and leg rest assembly, according to claim 1, wherein the at least one leaf member includes one or more locking pins and the top member includes one or more openings for releasably engaging the locking pins.

6. The foot and leg rest assembly according to claim 1, wherein the support assembly is formed from metal.

7. The foot and leg rest assembly according to claim 1, wherein the base portion includes a plurality of magnets to engage the support assembly.

8. The foot and leg rest assembly according to claim 1, wherein the stand member includes a compartment to receive the first and second leg members when the first and second leg members are folded.

9. The foot and leg rest assembly according to claim 1, wherein the support assembly is adjustable between a folded configuration and a plurality of extendible configurations.

10. A portable foot and leg rest assembly, comprising:

a main body including a top portion, a base portion and an intermediate portion provided between the base portion and top portion, the intermediate portion including at least one leaf member;

wherein the at least one leaf member is selectively attached to the top portion;

a foldable support assembly including first and second leg members and a stand member, each of the first and second leg members including first and second leg segments, the first and second leg segments being pivotably joined together, the first and second leg members being slidably connected to the base portion and to the stand member, the stand member including a first brace member, a second brace member, and a control assembly configured to facilitate height adjustment of the foot and leg rest assembly;

wherein the first and second leg segments each having proximal and distal ends; and a plurality of magnets disposed about the base portion, the plurality of magnets releasably engaging the support assembly.

11. The foot and leg rest assembly according to claim 10, wherein the first and second brace members each include an inner cavity and a track portion;

a rod member having a plurality of stop members extending from the inner cavity;

wherein the stop members are designed and configured to selectively extend into the track portion of the stand member to support each of the distal ends of each first and second leg segments therebetween.

12. The foot and leg rest assembly according to claim 10, wherein the first and second segments of each leg member are arranged in a scissor-like configuration and connected together by a pivot pin member.

13. The portable foot and leg rest assembly according to claim 10, wherein the control assembly is configured to selectively lock the distal portion of the leg segments into a selected position within the stand member, thereby locking the foot and leg rest assembly at a selected height.

14. The portable foot and leg rest assembly according to claim 10, wherein the base portion has a hollow lower portion for housing the support assembly.

15. The foot and leg rest assembly, according to claim 10, wherein the at least one leaf member includes one or more locking pins and the top member includes one or more openings for releasably engaging the locking pins.

16. The foot and leg rest assembly according to claim 10, wherein the support assembly is formed from metal.

17. The foot and leg rest assembly according to claim 10, wherein the stand member includes a compartment to receive the first and second leg members when the first and second leg members are folded.

18. The foot and leg rest assembly according to claim 10, wherein the support assembly is adjustable between a folded configuration and a plurality of extendible configurations.

* * * * *